US011149979B1

(12) United States Patent
Parsons

(10) Patent No.: US 11,149,979 B1
(45) Date of Patent: Oct. 19, 2021

(54) DECORATIVE AIR VENT APPARATUS

(71) Applicant: George Parsons, Saline, MI (US)

(72) Inventor: George Parsons, Saline, MI (US)

( * ) Notice: Subject to any disclaimer, the term of this patent is extended or adjusted under 35 U.S.C. 154(b) by 0 days.

(21) Appl. No.: 16/832,777

(22) Filed: Mar. 27, 2020

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/085; F24F 13/082; A47G 1/00
USPC ..... 454/275, 276; 40/725; D23/393, 388
See application file for complete search history.

(56) References Cited

U.S. PATENT DOCUMENTS 6,309,297 B1 * 10/2001 Berger ..... F24F 13/085 454/290
D825,049 S * 8/2018 Miskel ..... D23/388
D850,610 S * 6/2019 Drummond ..... D23/393
2006/0185381 A1 * 8/2006 Kim ..... F24F 1/0007 62/331
2006/0185382 A1 * 8/2006 Kim ..... F24F 13/20 62/331
2012/0124951 A1 * 5/2012 Miskel ..... B01D 46/2411 55/500
2014/0011439 A1 * 1/2014 Young ..... B23P 19/00 454/289
2014/0216259 A1 * 8/2014 Iwaki ..... F24F 11/30 96/19

FOREIGN PATENT DOCUMENTS

WO WO-9922179 A1 * 5/1999 ..... F24F 1/0007

* cited by examiner

*Primary Examiner* — Steven B Mcallister
*Assistant Examiner* — Charles R Brawner

(57) ABSTRACT

A decorative air vent apparatus can be used to cover air vent openings that supply heated or cooled air to a room from a central HVAC system. The decorative air vent is comprised of a housing, a decorative insert, and a decorative face plate. The housing supplants or is inserted into a conventional HVAC air vent opening and provides a space for the attachment and display of a decorative insert on the interior of the vent opening. The decorative face plate attaches to the housing, and has a central opening allowing for visual observation of the interior of the housing for the observer's enjoyment of the displayed decorative insert. The insert and face plate present artistic patterns or depictions and are interchangeable. When not used in conjunction with the housing, the decorative insert can be attached directly to the decorative face plate and displayed on a flat surface.

8 Claims, 2 Drawing Sheets

DECORATIVE AIR VENT APPARATUS

BACKGROUND

Today, most indoor spaces in homes and offices are warmed and cooled by a central heating, venting, and air conditioning (HVAC) system that pulls air from the building through ducts, warms or cools the air, and then returns it to various parts of the building through another series of ducts. A conventional HVAC system includes openings in each room that are attached to these ducts. These openings are usually concealed by a perforated cover known as a grille. Grilles are commonly constructed as rectangular panels that have a grill or a series of louvers that conceal the interior of the air vent.

A major disadvantage of conventional air vents is that they are designed primarily as functional instruments for introducing or removing air from a room. Although in some cases air vents have been provided with decorative face plates for enhancing the aesthetic appearance of the air vent, these face plates are meant to obscure visual observation of the interior of the air vent.

SUMMARY

The present invention is intended to address the utilitarian deficiencies found in these above-described conventional air vents. This invention is to provide a novel aesthetically pleasing air duct apparatus having decorative overlays, both on the exterior and interior of the air vent, which are removably mounted, and which can be readily removed and replaced by differently designed overlays.

In one form, the present invention provides a decorative air vent apparatus for enhancing the aesthetics of conventional HVAC air vents. The air vent apparatus includes a housing, a decorative insert, and a decorative face plate. The housing defines at least one air passageway therethrough and creates an unobstructed interior space for the display of the insert. The housing includes a flange configured to rest on the wall surrounding the duct opening and an interior screened divider to allow unimpeded air flow while maintaining a barrier to foreign materials into the duct work. The decorative face plate attaches to and covers the flange portion of the air vent. The face plate is configured to allow visual access to substantially all of the interior of the housing allowing for enjoyment of the displayed decorative insert.

DETAILED DESCRIPTION

Figure 1:
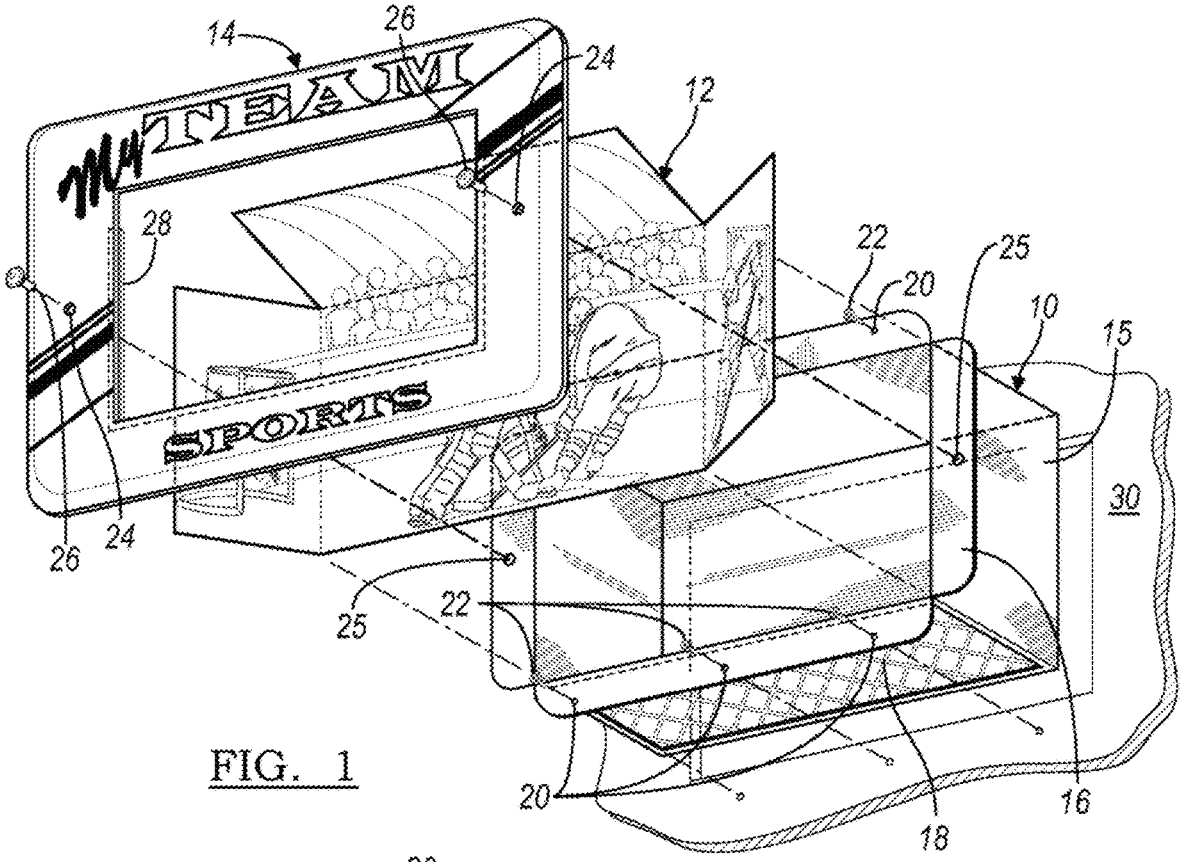
FIG. 1 is an exploded view of an air vent apparatus.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

For the purposes of promoting an understanding of the principles of the invention, reference will be made to the embodiments illustrated in the drawings and specific language will be used to describe the same. It will nevertheless be understood that no limitation of the scope of the invention is hereby intended. Alterations and further modifications in the illustrated devices, and such further applications of the principles of the invention as illustrated herein are contemplated as would normally occur to one skilled in the art to which the invention relates.

It will be appreciated that for simplicity and clarity of illustration, where appropriate, reference numerals have been repeated among different figures to indicate corresponding or analogous elements. In addition, numerous specific details are set forth in order to provide a thorough understanding of the embodiments described herein. However, it will be understood by those of ordinary skill in the art that the examples described herein may be practiced without these specific details.

In one form, the present invention provides an air vent apparatus for placement in an air duct. Referring to FIG. 1, the air vent apparatus according to an embodiment may include a housing 10, an insert 12, and a face plate 14. The housing has a body portion 15 and a flange 16, preferably constructed of stamped sheet metal including metals such as galvanized steel, stainless steel, and aluminum, or made from wood or plastic. The housing 10 is sized to fit into an air duct, and as depicted is generally rectangular in shape so as to fit into a standard rectangular air duct opening. However, the housing 10 can be constructed in various geometric configurations to conform to the configuration of existing air vents. The body portion 15 is defined by two sets of opposite side walls and a rear wall, creating an enclosure with an open front. The flange 16 extends around the periphery of the front of the body portion 15 to create a lip that can rest on and be secured to a wall 30 surrounding the air duct opening while the body portion 15 extends into the duct. In one embodiment, a series of apertures 20 defined by the flange 16 allow the housing 10 to be secured to the wall 30 with fasteners 22. It is to be appreciated in this use, the housing 10 would be mounted in an existing air duct as a replacement to the existing face plate. A screened divider 18 is affixed to a side wall of the housing 10 to impede objects from passing through the housing 10 into the duct work. In another embodiment, the screened divider is formed integrally with the side wall as a series of apertures defined by the side wall.

Embodiments are also contemplated where one or more purification devices are incorporated. A filter assembly is attachable over the screened divider 18. The filter assembly captures particulate material in the air traveling through the air passageway defined by the housing 10. The filter may be a single woven steel hygienic mesh, providing a thin filter easily fitting within the housing 10.

The insert 12 is preferably constructed of a foldable material suitable for the HVAC duct work environment of fluctuating temperature and humidity and bears a decorative composition, for example, an artistic design or depiction. In an embodiment, the insert 12 affixes to the side walls of the housing 10 to display the design when observed through the face plate 14. In other embodiments, the insert 12 is permanently attached to the interior of the side walls of the housing 10. In other embodiments, the interior of the side walls of the housing 10 bear the design or artwork, which can be displayed intrinsically or covered by the insert 12.

The face plate 14 is preferably stamped from a flat sheet of steel or made from wood or plastic. The face plate 14 is generally flat with an exterior surface and an interior surface. Preferably, the portion of the face plate 14 surrounding the central opening is flat, and the portion around the border of the face plate 14 may angle slightly away from the exterior surface. In one embodiment, the face plate 14 attaches to the housing 10 with fasteners 26 that extend through apertures 24 defined in the face plate 10. The fasteners 26 may also extend through apertures 25 defined in the flange 16 and engage the wall 30 behind the flange 16 in order to secure the face plate 14 to the wall 30 behind the flange 16. When the face plate 14 is attached to the housing 10, the angled border contacts the wall 30 forming a tight seam between the wall 30 and face plate. It is appreciated that the insert 12 and the face plate 14 are interchangeable with others of various designs and depictions without need of replacing the housing 10.

The face plate 14 attaches to the housing 10, covering the flange 16 while not appreciably obscuring the interior of the housing 10. The face plate 14 has a central opening dimensioned to allow substantially unimpeded visual observance of the interior of the housing 10. In one embodiment, the central opening may be rectangular in shape and as large as the front opening of the housing 10. Other embodiments of various geometric configurations that maintain visual access to the interior of the housing 10 are contemplated. In another embodiment, the central opening may include minimal structure 40 as part of the decorative design of the face plate 14. The minimal structure 40 may include vertical and/or horizontal members or bars that extend over the central opening but do not impede observance into the interior portion of the housing 10.

Figure 2:
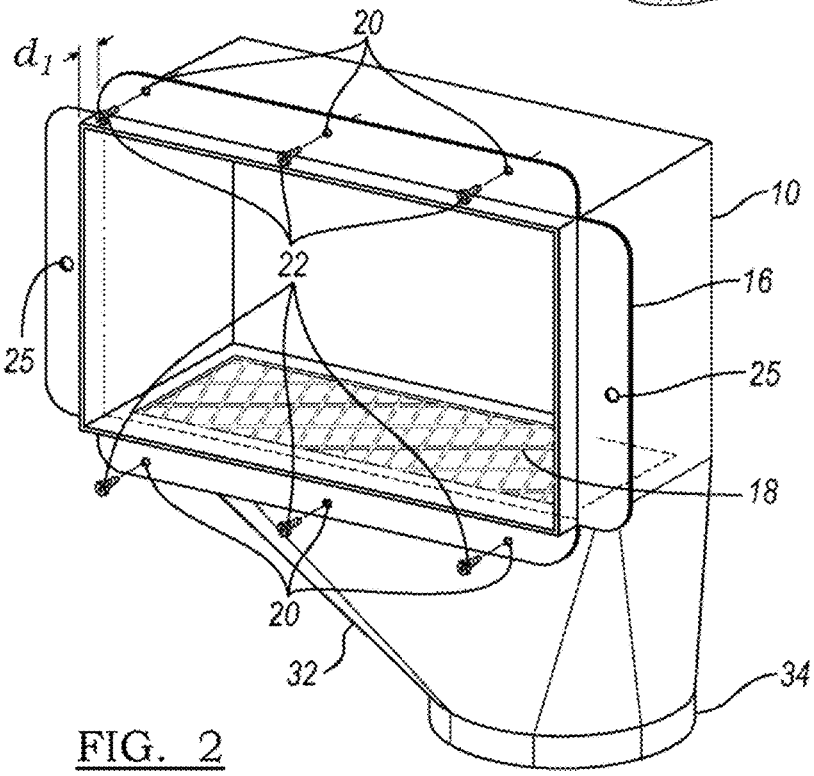
FIG. 2 is a perspective view of an air vent housing according to an alternative embodiment.

Referring now to FIG. 2, a perspective view of the air vent housing 10 is shown according to an alternative embodiment. The housing 10 includes a tapered portion 32 that extends from the side of the housing which includes the screened divider 18. The tapered portion 32 reduces the size of the air passageway to correspond to the size of existing HVAC duct work. A coupling 34 attached to the reduced end of the tapered portion 32 allows the housing to be directly attached to the existing ductwork. The coupling 34 is sized slightly smaller or larger than the existing ductwork allowing for an overlapping connection between them. The flange 16 is set back a distance d1, which may be the width of drywall or some other wall material that may be installed over the air vent. This allows the sidewalls to extend through the drywall or other wall material when the wall material is installed over the housing 10. In this use, the housing 10 would not be inserted into an existing air vent, it would serve to supplant the existing air vent.

Figure 3:
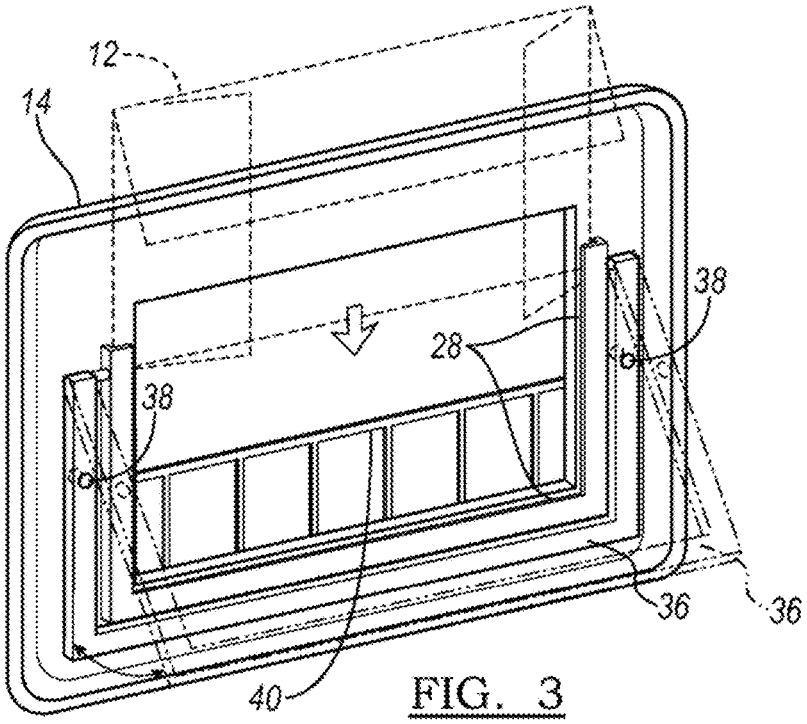
FIG. 3 is a perspective view of the interior side of a face plate according to an alternative embodiment.

FIG. 3 is a perspective view of the interior side of a face plate according to an alternative embodiment. The face plate includes a channel 28 and a stand 36. The channel 28 is configured in an L-shape and protrudes from the interior of the face plate 14 around the bottom and sides of the central opening. The channel 28 faces inwardly toward the central opening. The insert 12 is folded and slid into the channel 28 for storage and display. A collapsible stand 36 is attached to the interior surface of the face plate forming an easel when extended.

In one embodiment, the stand 36 is attached to a pivot on each side of the channel 28 and extends across the bottom of the opening. When the stand 36 is pivoted away from the face plate 14, the face plate 14 is self-supported in a vertical position and can be displayed on a flat surface without need of the housing 10. When collapsed, the stand 36 is positioned within a cavity defined along the rear or backside of the face plate 14, allowing the angled border portion to be flat against a wall when attached to the housing 10. A plurality of apertures 38 defined by the stand 36 allow fasteners 26 to pass through the stand 36 in order to secure the face plate 14 to the housing 10.

Figure 4:
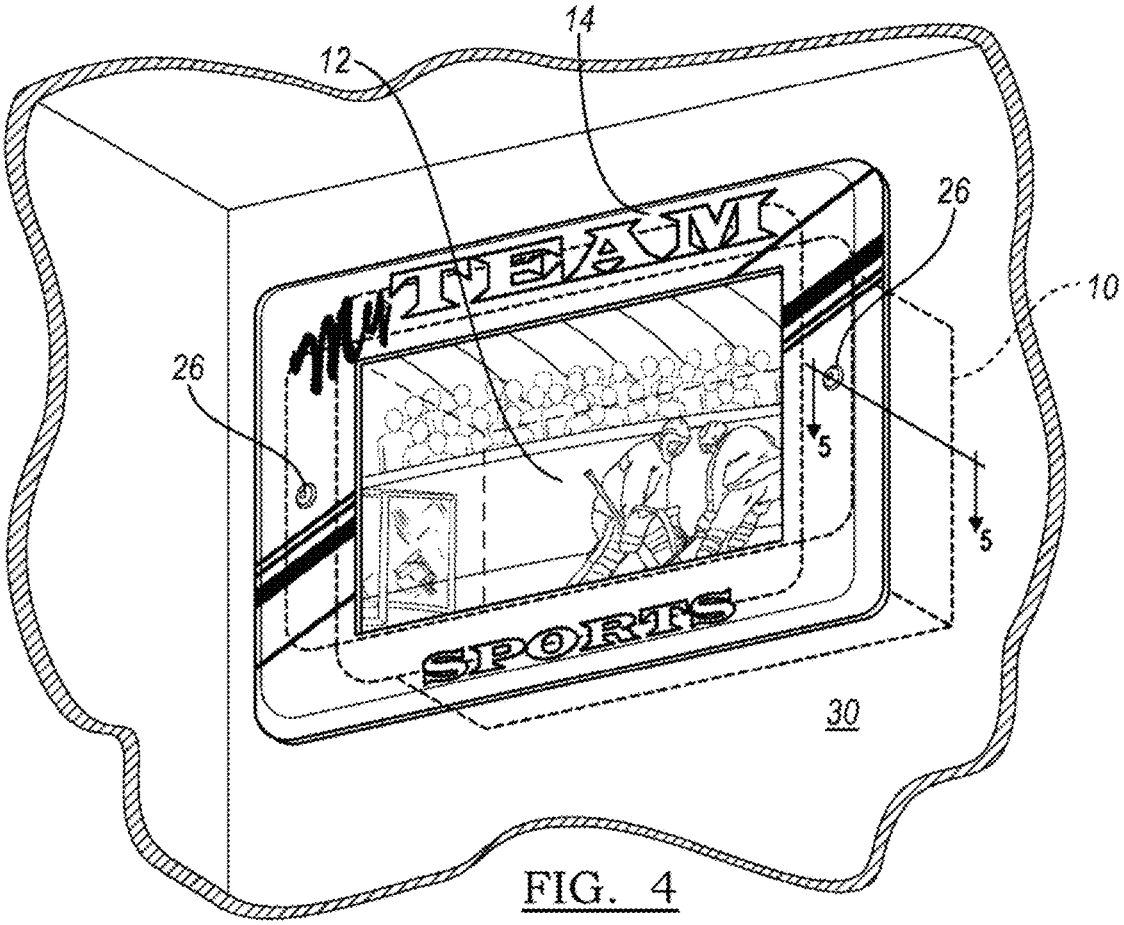
FIG. 4 is a perspective view of the FIG. 1 air vent apparatus inserted into an air duct in a room.

The following example is provided with reference to FIG. 4 for purposes of illustrating an exemplary use of the air vent provided herein. However, it should be understood that the present disclosure should not be limited to this example, and that many variations of this example are contemplated. The housing 10 is inserted into an existing HVAC return air vent on the wall 30 and secured to via fasteners 22 through apertures 20. The insert 12 is frictionally attached to the housing. The face plate 14 attaches to the housing 10 via fasteners 26 through apertures 24 and 25. In this embodiment, the insert 12 bears a depiction of a sports scene and the face plate 14 bears a corresponding sports themed design. Other embodiments of various depictions and designs are contemplated.

Figure 5:
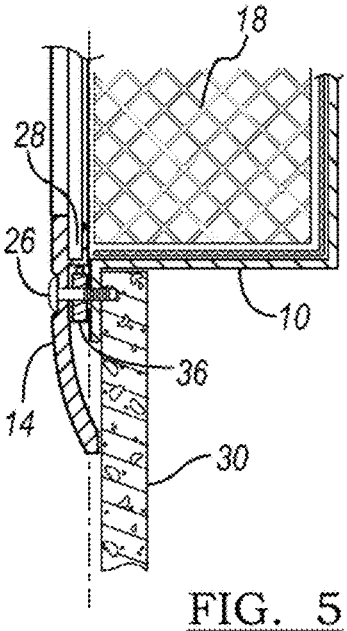
FIG. 5 is a top down, section view of an air vent apparatus, taken along the section line 5-5 of FIG. 4.

FIG. 5 is a top down, section view of an air vent apparatus, taken along the section line 5-5 of FIG. 4. The face plate 14 is attached to the housing 10 and secured to the wall 30. The border of the face plate 14 angles inwardly toward the wall 30. The stand 36 and the channel 28 do not extend past the curved portion from the interior side of the face plate 14. Thus, the stand 36 and the channel 28 are contained within the cavity formed by the contact between the curved border portion of face plate 14 and the wall 30 forming a tight seam.

While the invention has been illustrated and described in detail in the drawings and foregoing description, the same is to be considered as illustrative and not restrictive in character. Only certain embodiments have been shown and described, and all changes, equivalents, and modifications that come within the spirit of the invention described herein are desired to be protected. The description and the attached drawings should not be interpreted to limit the scope of this invention to the specifics thereof. Rather, the scope of this invention should be evaluated with reference to the claims appended hereto.

What is claimed is:

1. A decorative air vent apparatus comprising:

a housing dimensioned to be insertable into an airduct opening, having an exterior surface and an opposite interior surface that surrounds an interior volume of the housing, and defining a first opening and a second opening; and a flange extending from the exterior surface encompassing the first opening and configured to attach the housing to a wall such that the housing is maintained within an air duct; and a screened divider disposed over the second opening configured to impede solid materials while allowing airflow through an air passageway; and a face plate having an exterior surface and an interior surface, attachable to the housing, and defining an interior opening to allow visual access into the interior of the housing via the first opening, the exterior surface bearing a decorative composition.

2. The apparatus of claim 1, wherein the interior surface of the housing bears a decorative composition.

3. The apparatus of claim 1, further comprising:

an air filter attached to the screened divider.

4. The apparatus of claim 1, further comprising a plurality of apertures defined by the face plate, wherein the plurality of apertures are configured to receive fasteners.

5. The apparatus of claim 1 further comprising:

a collapsible stand attached to the interior surface of the face plate, the stand configured to be flat against the interior surface when collapsed and extended away from the interior surface when expanded.

6. The apparatus of claim 5, further comprising:

a plurality of apertures defined by the stand, wherein the apertures are configured to receive fasteners.

7. The apparatus of claim 1, wherein the housing is formed of galvanized steel.

8. The apparatus of claim 1 further comprising:

a protrusion extending from the interior surface of the face plate and defining a channel configured to receive the insert.

* * * * *